US005637009A

United States Patent [19]

Tsuji et al.

[11] Patent Number: 5,637,009

[45] Date of Patent: Jun. 10, 1997

[54] CONNECTOR EQUIPPED WITH ENGAGEMENT DETECTING MEMBER

[75] Inventors: Masanori Tsuji; Haruki Yoshida, both of Shizuoka, Japan

[73] Assignee: Yazaki Corporation, Tokyo, Japan

[21] Appl. No.: 598,390

[22] Filed: Feb. 8, 1996

[30] Foreign Application Priority Data

Feb. 10, 1995 [JP] Japan ..... 7-022536
Jun. 19, 1995 [JP] Japan ..... 7-151795

[51] Int. Cl.[6] ..... H01R 4/50

[52] U.S. Cl. ..... 439/347; 439/489

[58] Field of Search ..... 439/347, 488, 439/489, 351, 352, 353

[56] References Cited

U.S. PATENT DOCUMENTS 5,257,944 11/1993 Kennedy ..... 439/489

FOREIGN PATENT DOCUMENTS 0294382 11/1989 Japan ..... 439/347
3-74483 7/1991 Japan .
4-209478 7/1992 Japan .
6-54255 7/1994 Japan .

*Primary Examiner*—David L. Pirlot
*Assistant Examiner*—Tho Dac Ta
*Attorney, Agent, or Firm*—Armstrong, Westerman, Hattori, McLeland & Naughton

[57] ABSTRACT

In a connector equipped with an engagement detecting member, the engagement detecting member is mounted on male connector housing which allows it to move freely in the direction perpendicular to engagement detection of a pair of male and female connector housings engaged with each other, a driving portion which has an inclined surface extending from an operating portion to a free end portion is provided for the engagement detecting member, the engagement of the connector housing is carried out, while contacting a guide protuberance provided for female connector housing with an inclined surface, it causes the engagement detecting member to project laterally concerning the one side of connector housing.

6 Claims, 11 Drawing Sheets

CONNECTOR EQUIPPED WITH ENGAGEMENT DETECTING MEMBER

BACKGROUND OF THE INVENTION

1. Field of the invention

The present invention relates to a connector equipped with an engagement detecting member which is capable of detecting whether or not a female connector and a male connector are perfectly engaged with each other.

2. Description of the Prior Art

An example of a conventional connector provided with a detecting means for detecting whether or not a female connector and a male connector are perfectly engaged with each other is shown in FIG. 20 (Japanese Patent Application Laid-Open No. Heisei 4-209478), as the connector K.

The connector K comprises a female connector housing "a" and a male connector housing "b" both of which form a pair of connector. A detecting piece "d" is inserted into a detecting piece hole "c" of the female connector housing "a" which allows it to move freely up and down. Meanwhile a locking piece "e" is provided for the male connector housing "b".

When the female connector housing "a" and the male connector housing "b" are normally engaged with each other, as shown in FIG. 21, the locking piece "e" of the male connector housing "b" causes the detecting piece "d" to push up from the underside, a front projection of the detecting piece "d" permits the engagement both of the connector housings "a" and "b" to detect.

When the female connector housing "a" and the male connector housing "b" are incompletely engaged with each other, the locking piece "e" is pressed down continuously, accordingly no front projection enables the incompleteness of the engagement to detect.

However, connector K can not excessively be enlarged since it causes the detecting piece "d" to project after engagement. If the connector K is enlarged, wide occupied space is required for connecting the connectors with the result that it puts an arrangement for the components at disadvantage. It becomes difficult to confirm the projection of the detecting piece "d" in case of small detecting piece "d", with the result that a mistake tends to take place. There are problems that it causes the reliability of the engagement detection to deteriorate, since a detecting piece "d" is inserted into a detecting piece hole "c" of the female connector housing "a" which allows it to move freely up and down, this introduces the danger that even if the engagement of the connectors is incomplete, the detecting piece projects from the detecting piece hole on account of the cause of some kind.

SUMMARY OF THE INVENTION

In view of the foregoing, it is an object of the present invention to provide a connector equipped with an engagement detecting member in which the engagement between the female connector housing and the male connector housing can be distinctly detected, and the locking between the female connector housing and the male connector housing is possible.

According to the first aspect of the present invention, for achieving the above-mentioned objects, there is provided a connector having an engagement detecting member with a driving portion, which is mounted on one side of connector housing which allows it to move freely in the direction perpendicular to the engagement direction of a pair of connector housings engaged with each other, an inclined surface which is provided for the driving portion, extending toward the opposite side from an engagement side of the connector housings of an operating portion provided at one end of the engagement detecting member to a free end portion, a guide protuberance which comes into contact with the inclined surface provided for an opening end of the other side of connector housing, and a driving portion insertion hole provided for the guide protuberance adjacent thereto.

According to the second aspect of the present invention there is provided a connector equipped with an engagement detecting member having a detecting member accommodating hole being perpendicular to the engagement direction, a sliding portion of the engagement detecting member which is inserted into the detecting member accommodating hole which allows it to move freely therein, and an introducing groove for receiving the sliding portion provided for the other side of connector housing.

According to the third aspect of the present invention there is provided a connector equipped with an engagement detecting member wherein the engagement detecting member is provided with a tapered engagement guide surface on the opposite side of the inclined surface of the driving portion.

According to the fourth aspect of the present invention there is provided a connector equipped with an engagement detecting member having an engaging projection provided for the sliding portion of the engagement detecting member, an urging protuberance and an engaging protuberance which come into contact with the engaging projection provided for the engagement detecting member accommodating hole wherein it permits an installation of the engagement detecting member to guide by virtue of the inertial force in the insertion of the engagement detecting member.

According to the fifth aspect of the present invention there is provided a connector equipped with an engagement detecting member wherein with regard to said engagement detecting member, a resilient board portion is provided at the sliding portion, and an engaging projection is provided at the resilient board portion.

According to the sixth aspect of the present invention there is provided a connector equipped with an engagement detecting member having an introducing wall for one side of connector housing, being provided for the inside of a hood portion of the other side of connector housing, and a reinforcing wall provided between the introducing wall and a ceiling wall of said hood portion.

As stated above, the connector equipped with the engagement detecting member according to the first aspect of the present invention is provided with an engagement detecting member with a driving portion having an inclined surface sharpened toward the engagement direction, which is mounted on one side of connector housing which allows it to move freely in the direction (lateral direction) perpendicular to the engagement direction of a pair of connector housings thereby in case that the engagement of the connectors is carried out, while contacting a tapered portion of the guide protuberance provided for the other side of connector housing with an inclined surface of the engagement detecting member, it causes the engagement detecting member to project outward from the one side of connector housing, since the engagement detecting member is extruded to the outside of the connector housing, by watching the engagement detecting member projected from the side wall of the connector housing, the process of the engagement between the male type connector housing and the female type connector housing is detected easily.

As stated above, the connector equipped with the engagement detecting member according to the second aspect of the present invention when the male type connector housing and the female type connector housing are completely engaged with each other, it enable the driving portion of the engagement detecting member to lock by pushing thereof into the driving portion insertion hole of the other connector housing, and it is capable of begin detected easily that the engagement is perfect in accordance with the locking, when the male type connector housing and the female type connector housing are engaged incompletely with each other, it does not enable the driving portion to push into the driving portion insertion hole, accordingly the connectors can not be locked with each other, with the result that the incompletely engagement can easily be detected, and the undesired locking is prevented.

As stated above, the connector equipped with the engagement detecting member according to the third aspect of the present invention is provided with the tapered engagement guide surface at the opposite side of the inclined surface of the driving portion, in case that the engagement between the male type connector housing and the female type connecter housing is somewhat insufficient, owing to pressing the engagement detecting member, it causes the engagement guide surface to push into the driving portion insertion hole, while sliding to the guide protuberance so that it enables the male type connector housing to enter completely into the female type connector housing. In case of the insufficient engagement, when it causes the engagement detecting member to press, it enables the male type connector housing to press back to the condition that the terminal of the male type connector housing and the terminal of the female type connecter housing are nonconducting state.

As stated above, the connector equipped with the engagement detecting member according to the fourth aspect of the present invention is provided the urging protuberance and the engaging protuberance for the detection accommodating hole, in inserting the engagement detecting member into the detecting member accommodating hole, it causes the pressing force needed for climbing over the urging protuberance for the engaging projection provided for the sliding portion of the engagement detecting member to increase, by the inertial force at the time the engaging projection climbing over the urging protuberance, it permits the engaging projection to climb over the engaging protuberance and it becomes possible that the inertial force causes the engagement detecting member to engage surely with the required position.

As stated above, the connector equipped with the engagement detecting member according to the fifth aspect of the present invention wherein with regard to said engagement detecting member, a resilient board portion is provided for the sliding portion, and an engaging projection is provided for the resilient board portion thereby the engagement to the engaging protuberance provided for detecting member accommodating hole of one side of the connector housings is elastically performed, accordingly, there are many advantages that the engagement detecting member can move smoothly, and engaging thereof becomes certain.

As stated above, the connector equipped with the engagement detecting member according to the sixth aspect of the present invention is provided a connector equipped with an engagement detecting member having an introducing wall for one side of connector housing, being provided for the inside of a hood portion of the other side of connector housing, and a reinforcing wall provided between the introducing wall and a ceiling wall of said hood portion, even though the openings such as the introducing groove formed by notching the side wall and the driving portion insertion hole on the side wall of the hood portion are provided, the ceiling wall does not bend, it enables the operation of the engagement detecting member to carry out smoothly and certainly.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

A preferred embodiment of the invention will now be described in detail referring to the accompanying drawings.

Figure 1:
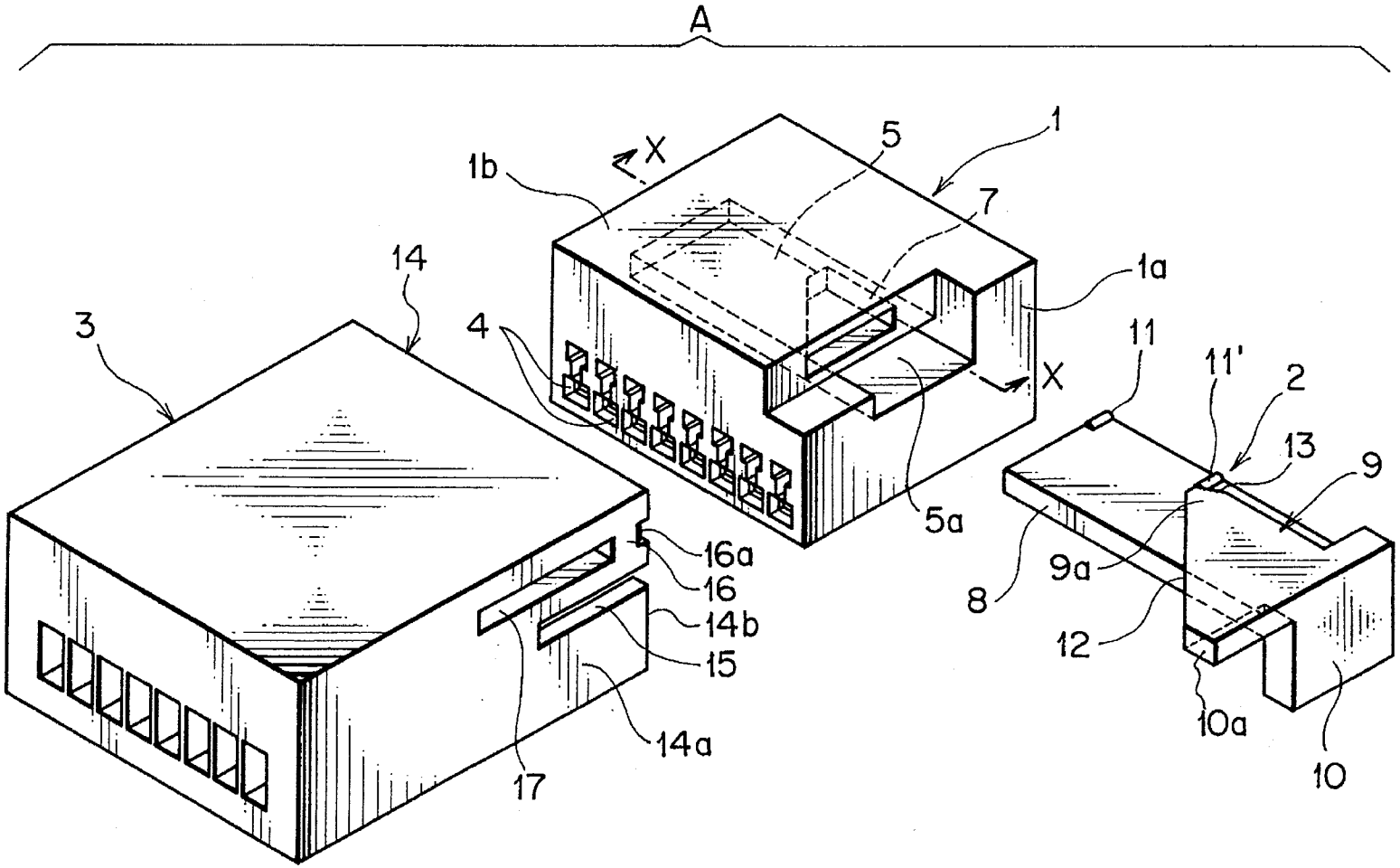
FIG. 1 is a perspective view showing a separated connector equipped with an engagement detecting member according to an embodiment of the invention.
Figure 2:
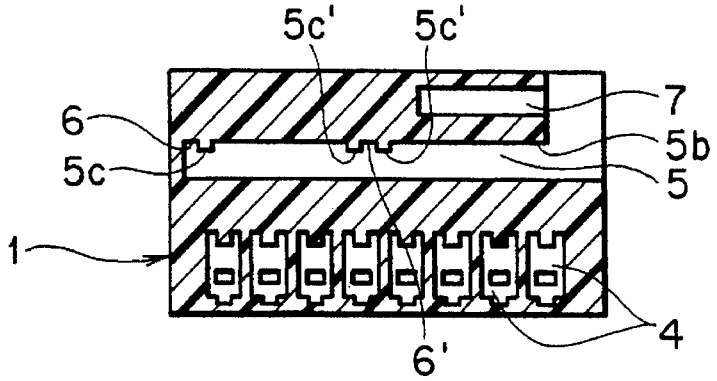
FIG. 2 is a sectional view taken along the line X—X of one connector housing of FIG. 1.

FIG. 1 is a perspective view showing a separated condition of a connector A equipped with an engagement detecting member according to one embodiment of the present invention.

The connector A equipped with the engagement detecting member which is a pair of connectors comprises a male type connector housing 1, an engagement detecting member 2, and a female type connector housing 3, wherein the male type connector housing 1 and the female type connector housing 3 are engaged with each other.

A plurality of terminal accommodating cavities 4 are provided for the male type connector housing 1, female type terminal metal parts (not illustrated) are accommodated therein. A detecting member accommodating hole 5 with an opening 5*a* is provided perpendicularly to the engagement direction of the connector housings 1 and 3 for a side wall 1*a* of the connector housing 1 above the terminal accommodating cavity 4. There are provided an engaging hollow portion 6 partitioned by a low partition wall 5*c* at the inner part and an engaging hollow portion 6' partitioned by low partition walls 5*c*', 5*c*' at the intermediate part for the upper wall 5*b* of the detecting member accommodating hole 5. A driving portion accommodating cavity 7 is provided for between the upside of the detecting member accommodating hole 5 and the upside wall 1*b* of the male type connector housing 1.

The engagement detecting member 2 is formed in such a condition that a rectangular board shaped sliding portion 8 and a triangle board shaped driving portion 9 are provided side by side with the required space for an operating portion 10.

Engaging projections 11, 11' which are engaged with the engaging hollow portions 6, 6' provided for the upper wall 5*b* of the detecting member accommodating hole 5 are provided for the sliding portion 8.

The driving portion 9 comprises an inclined surface 12 extending toward the opposite side from the connection housing engagement side 10*a* to a free end portion 9*a* of the operating portion 10, and a tapered engagement guide surface 13 at the opposite side of the inclined surface 12 from the free end portion 9*a*.

The female type connecter housing 3 is a housing which accommodates male type terminal metal parts connected to the female type terminal metal parts accommodated into the male type connector housing 1, a hood portion 14 which receives the male type connector housing 1 is provided for the engagement portion thereof. An introducing groove 15 which receives the sliding portion 8 of the engagement detecting member 2 in case of engagement is formed, with a side wall 14*a* from an opening end 14*b* of the hood portion 14 notched, at the side wall 14*a* of the hood portion 14 corresponding to the side wall 1*a* of the male type connector housing 1.

A guide protuberance 16 is provided for the opening end 14*b* above the introducing groove 15, the drive portion insertion hole 17 is provided adjacent thereto. A taper portion 16*a* in contact with the inclined surface 12 of the driving portion 9 of the engagement detecting member 2 is formed at the opening end 14*b* side of the hood portion 14 of the guide protuberance 16.

Figure 3:
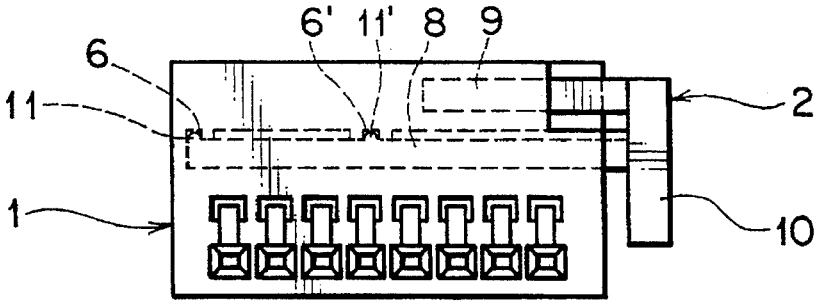
FIG. 3 is an elevational view showing one connector housing of FIG. 1.
Figure 4:
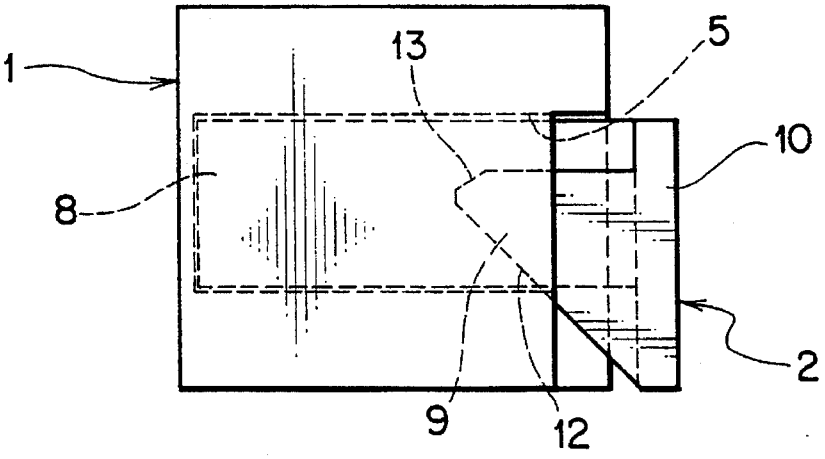
FIG. 4 is a plan view showing one connector housing of FIG. 1.

FIGS. 3 and 4 designate the condition that it causes the engagement detecting member 2 to insert into the male type connector housing 1. The sliding portion 8 inserted into the detecting member accommodating hole 5 does not miss simply unless the external force is applied to the engagement detecting member 2, since the sliding portion 8 is engaged in such a way that the engaging projections 11, 11' are engaged with the engaging hollow portions 6, 6' of the detecting member accommodating hole 5.

Figure 5:
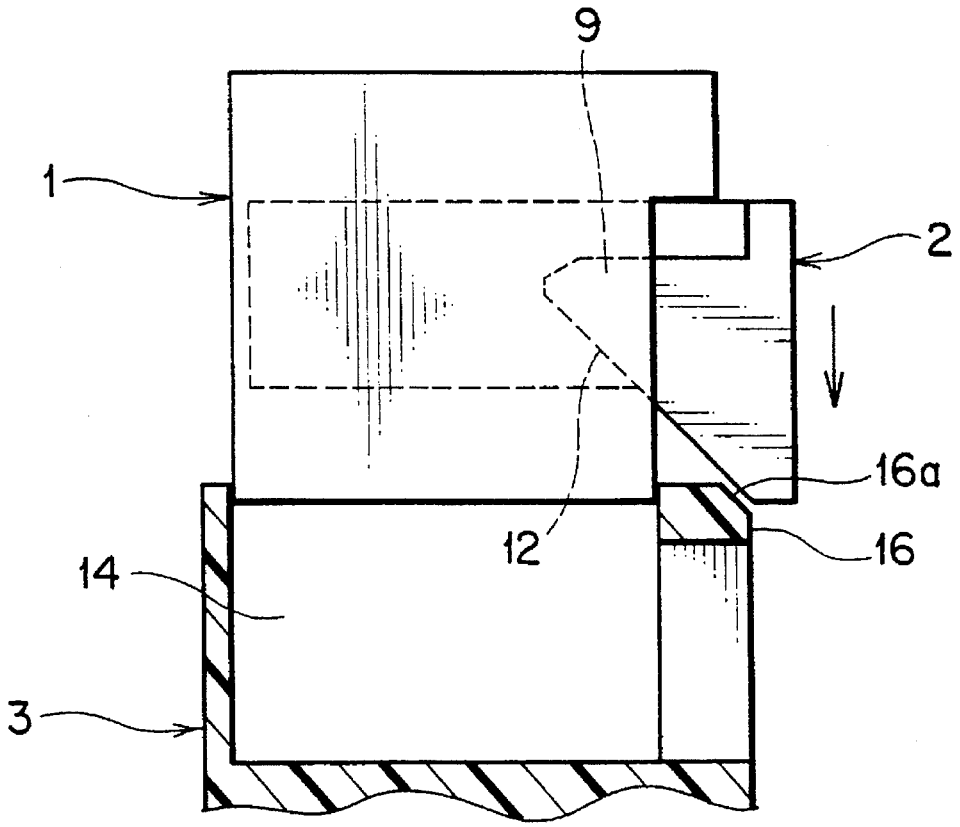
FIG. 5 is an explanatory view showing a process of engagement the female connector housing and the male connector housing of FIG. 1.

Next, the process of engagement between the male type connector housing 1 mounting the engagement detecting member 2 and the female connector housing 3 will be explained. FIG. 5 designates the condition that it causes the male type connector housing 1 to dispose just in front of the hood portion 14 of the female type connector housing 3. From this condition, when it causes the male connector housing 1 to enter into the hood portion 14 of the female connector housing 3 as indicated by the arrow, the inclined surface 12 of the driving portion 9 of the engagement detecting member 9 comes into contact with the taper portion 16*a* of the guide protuberance 16.

Figure 6:
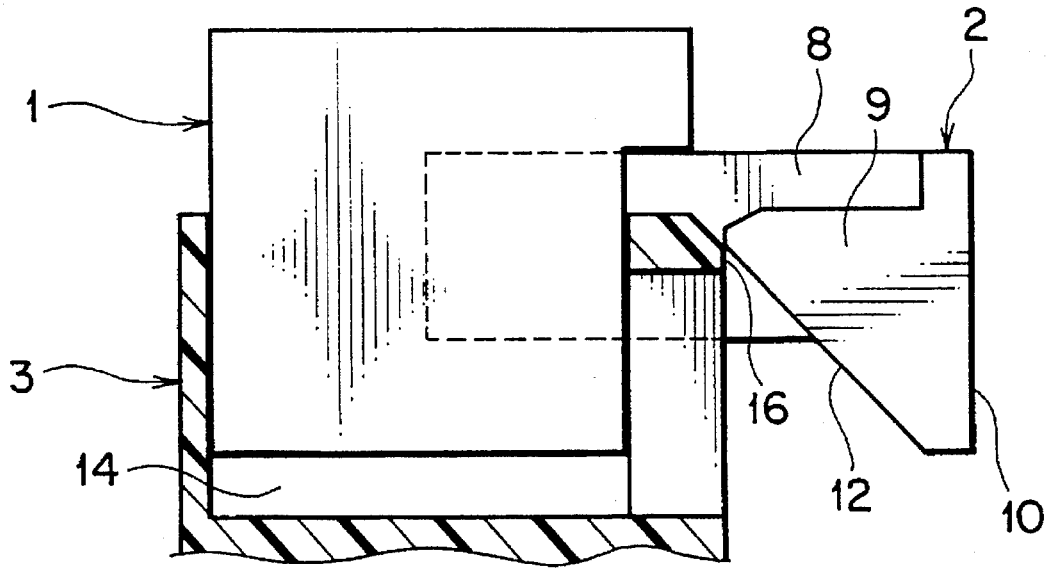
FIG. 6 is an explanatory view showing a condition in the course of engagement between the female connector housing and the male connector housing of FIG. 5.

Further, as shown in FIG. 6, with the approach of the male type connector housing 1, the sliding portion 8 is extruded from the detecting member accommodating hole 5 of the male type connector housing 1 so as to project caused by the action between the taper portion 16*a* of the guide protuberance 16 and the inclined surface 12.

Figure 7:
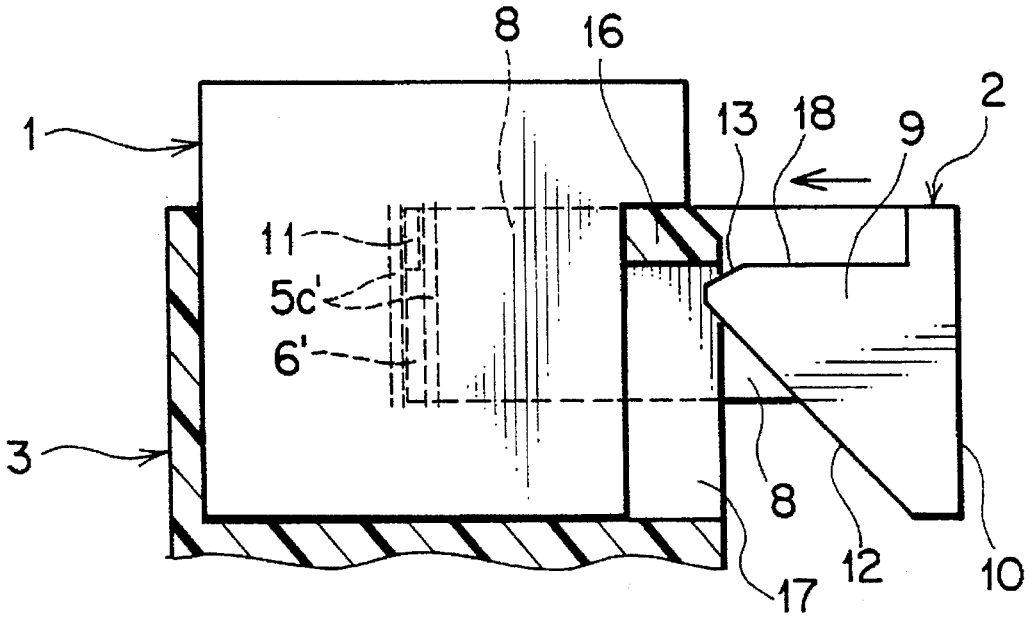
FIG. 7 is an explanatory view showing a condition of engagement between the female connector housing and the male connector housing of FIG. 6.

As shown in FIG. 7, when the male type connector housing 1 and the female type connector housing 3 are completely engaged with each other, the inclined surface 12 of the driving portion 9 of the engagement detecting member 2 departs from the guide protuberance 16, it permits the driving portion 9 to arrive at the position where it enables the driving portion 9 to enter into the driving portion insertion hole 17. At this time, the engaging projection 11 of the sliding potion 8 engages with the engaging hollow portion 6' of the detecting member accommodating hole 5.

Figure 8:
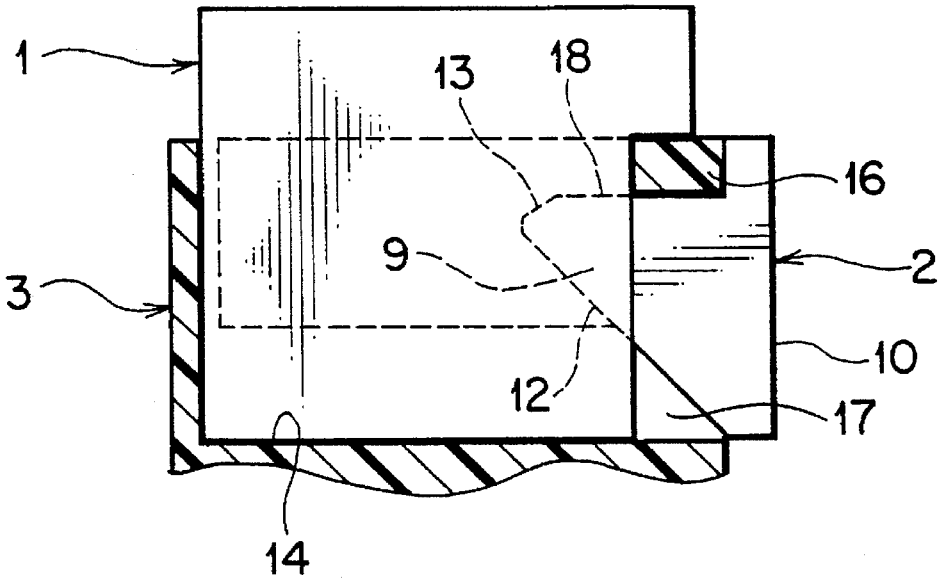
FIG. 8 is an explanatory view showing a condition that it causes the engagement detecting member to press into a drive portion insertion hole of FIG. 7.

At this condition, as shown in FIG. 8, when it causes the operating portion 10 of the projected engagement detecting member 2 to press to the direction as indicated by the arrow, the driving portion 9 is accommodated into the hood portion 14, with the driving portion 9 entered into the driving portion insertion hole 17 of the male type connector housing 3. When it permits the driving portion 9 to enter into the driving portion insertion hole 17, a rear end surface 18 of the driving portion 9 comes into contact with the guide protuberance 16 so that the engagement detecting member 2 engages with the female type connector housing 3 with the result that the male type connector housing 1 and the female type connector housing 3 are locked with each other.

Even though the engagement between the male type connector housing 1 and the female type connecter housing 3 is somewhat insufficient, if the engagement guide surface 13 of the driving portion 9 rests on the position where the engagement guide surface 13 comes into contact with the guide protuberance 16, owing to pressing the operating portion 10 of the engagement detecting member 2, the engagement guide surface 13 slides to the guide protuberance 16 so that it causes the male type connector housing 1 to enter into the female type connector housing 3, with the result that it enables the perfect engagement to achieve.

On the other hand, in case of the insufficient engagement, in the condition as shown in FIG. 6, when it causes the engagement detecting member 2 to press, it enables the male type connector housing 1 to press back to the condition that the terminal of the male type connector housing 1 and the terminal of the female type connecter housing 3 are non-conducting state.

Figure 9:
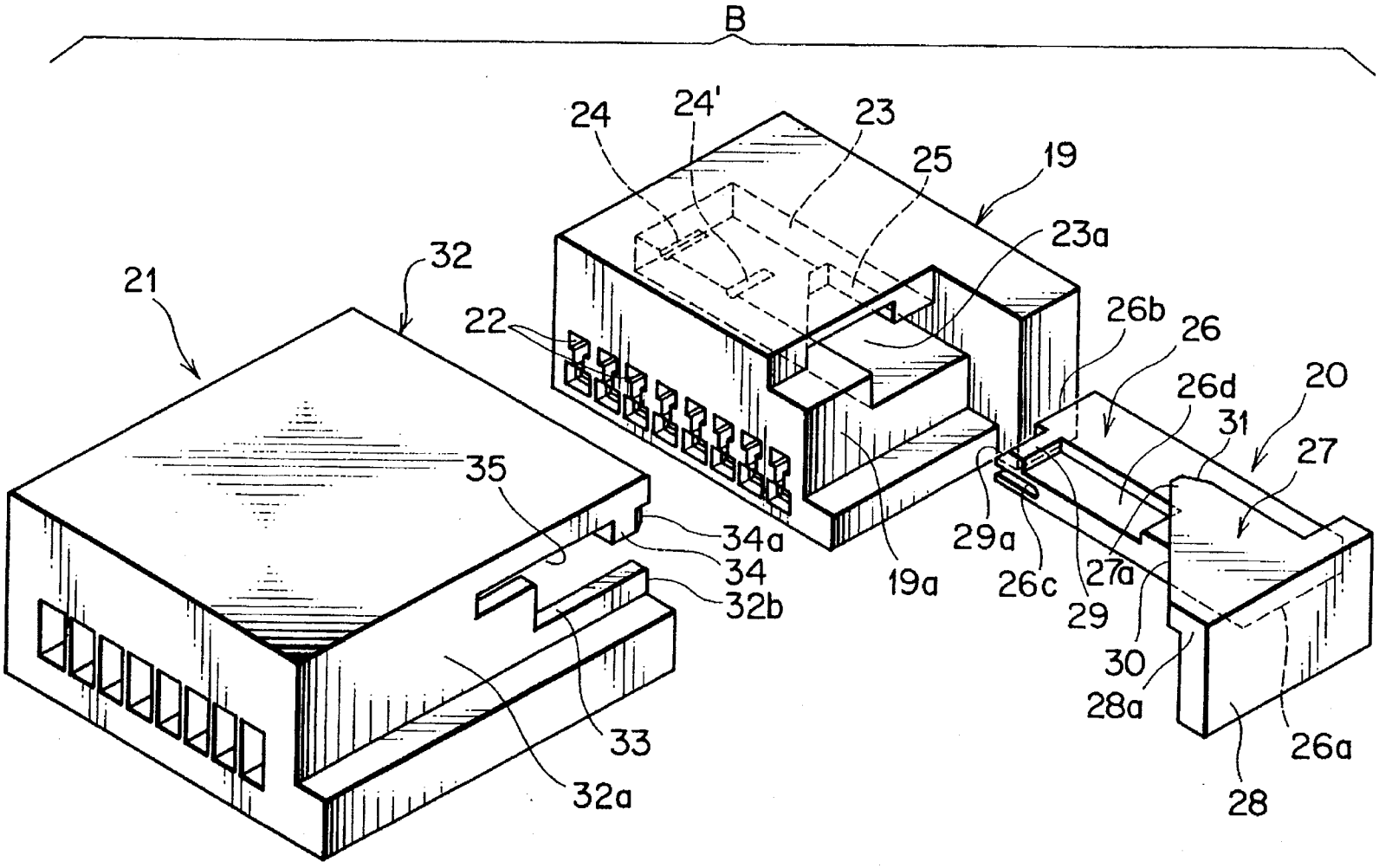
FIG. 9 is a perspective view showing a separated connector equipped with an engagement detecting member according to an another embodiment of the present invention.

FIG. 9 is a perspective view showing the separated condition of the connector B with an engagement detecting member according to the another embodiment of the present invention.

The connector B with an engagement detecting member comprises a male type connector housing 19, an engagement detecting member 20 and a female type connector housing 21.

A plurality of terminal accommodating cavities 22 are provided for the inside of the male type connector housing 19 which is the same as said male type connector housing 1, female type terminal metal parts are accommodated therein. A detecting member accommodating hole 23 having an opening 23*a* is provided perpendicularly to the engagement direction of the connector housing 19 for a side wall 19*a* of the connector housing 19 above the terminal accommodating cavity 22.

There are provided an engaging projection 24 for engaging the engagement detecting member 20 at the inner part of the upper wall 23*b* (referring to FIG. 10) and an urging projection 24' at the intermediate part for the upper wall 23*b* of the detecting member accommodating hole 23. The projection height of urging projection 24' is higher than that of the engaging projection 24 the operation of which will be described later, it causes the engagement detecting member 20 to urge to the inserting direction in inserting the engagement detecting member 20 into the detecting member accommodating hole 23. Further a driving portion accommodating portion 25 is provided for the upper wall 23*b* of the opening portion 23*a* side with the driving portion accommodating portion made concave.

The engagement detecting member 20 is formed in such a condition that a rectangular board shaded sliding portion 26 and a triangle board shaped driving portion 27 are formed integrally, the operating portion 28 attaches to one end portion 26*a* of the sliding portion 26. A thin wall resilient board portion 26*c* formed by biting the end portion is provided for the other end portion 26*b* of the sliding portion 26.

A step-like portion 26*d* is formed by notching one upper edge portion of the sliding portion 26, an engaging projection 29 which engages with an engaging protuberance 24 of the detecting member accommodating hole 23 is provided for the position above resilient board portion 26*c*. A taper portion is formed at the engaging projection 29 toward the other end 26*b* of the sliding portion 26. There is provided the driving portion 27 with an inclined portion 30 extending to a free end portion 27*a* from a connector housing engagement side 28*a* of the operating portion 28 in the opposite direction thereto and with a tapered engagement guide surface 31 to the opposite end of the inclined surface 30 from the free end portion 27*a*.

The female type connecter housing 21 is a housing which accommodates male type terminal metal parts connected to the female type terminal metal parts accommodated into the male type connector housing 19, a hood portion 32 which receives the male type connector housing 19 is provided for the engagement portion thereof. An introducing groove 33 for receiving the sliding portion 26 of the engagement detecting member 20 in case of engagement is formed, with a side wall 32*a* from an opening end 32*b* of the hood portion 32 notched.

A guide protuberance 34 is provided for the opening end 32*b* above the introducing groove 33, the drive portion insertion hole 35 is provided continuously to the introducing groove 33 adjacent thereto.

A taper portion 34*a* which comes in contact with the inclined surface 30 of the driving portion 27 of the engagement detecting member 20 is formed at the opening end 32*b* side of the hood portion 32 in the guide protuberance 34.

Figure 10:
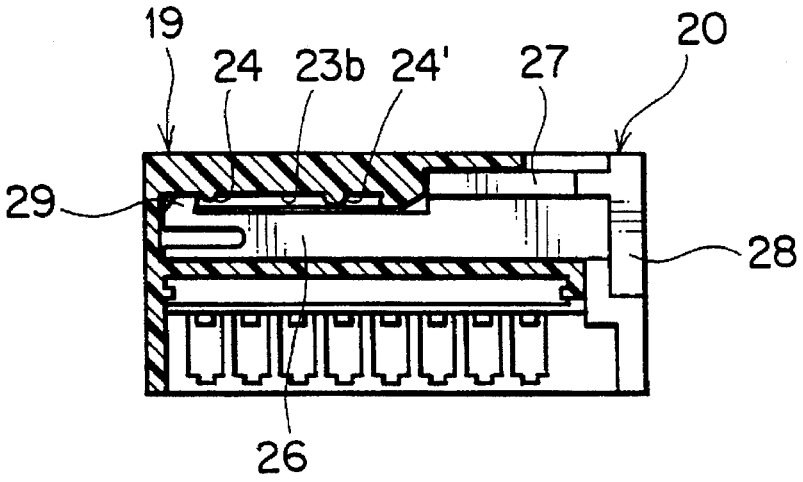
FIG. 10 is a sectional view showing a condition in which the engagement detecting member is mounted into a detecting member accommodating hole of one connector housing of FIG. 9.

FIG. 10 designates the condition that it causes the engagement detecting member 20 to mount on the male type connector housing 19. The sliding portion 26 inserted into the detecting member accommodating hole 23 does not miss simply unless the external strong force is applied to the engagement detecting member 20, since the sliding portion 26 is engaged with the engaging projection 29.

Figure 11:
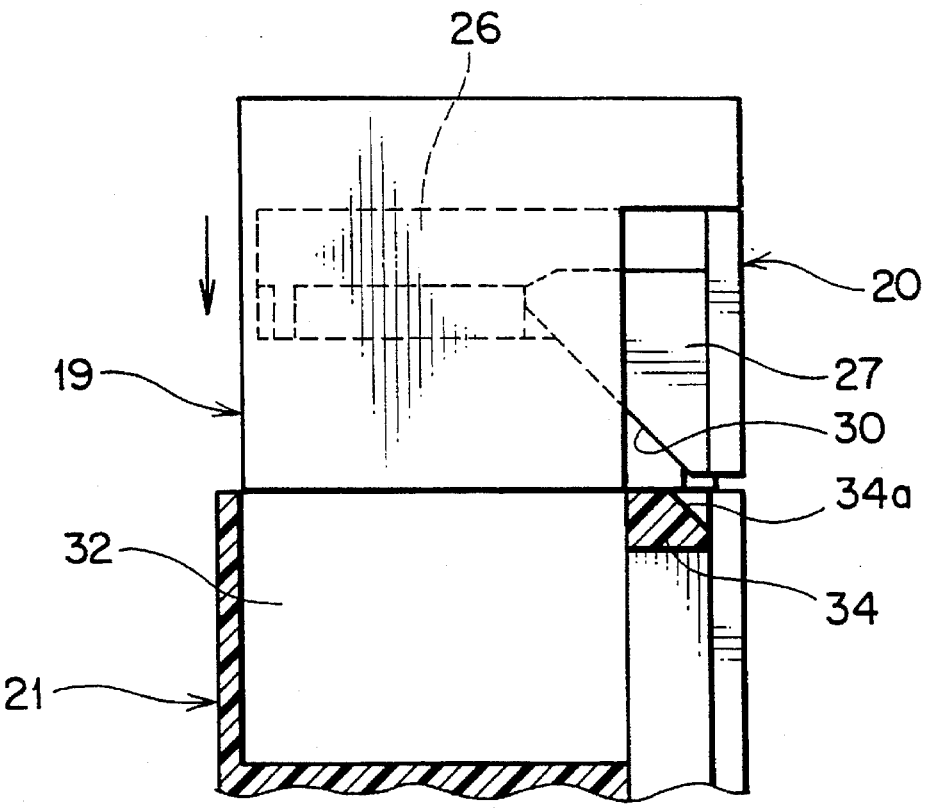
FIG. 11 is an explanatory view showing a process in which the female connector housing and the male connector housing are engaged with each other.

The process of the engagement between the male type connector housing 19 with the engagement detecting member 20 and the female type connector housing 21 is about the same as said connector A with the engagement detecting member. FIG. 11 designates the condition that it causes the male type connector housing 19 to dispose just in front of the hood portion 32 of the female type connector housing 21. From this condition, when it causes the male connector housing 19 to enter into the hood portion 32 of the female connector housing 21 as indicated by the arrow, the inclined surface 30 of the driving portion 27 of the engagement detecting member 20 comes into contact with the taper portion 34*a* of the guide protuberance 34.

Figure 12:
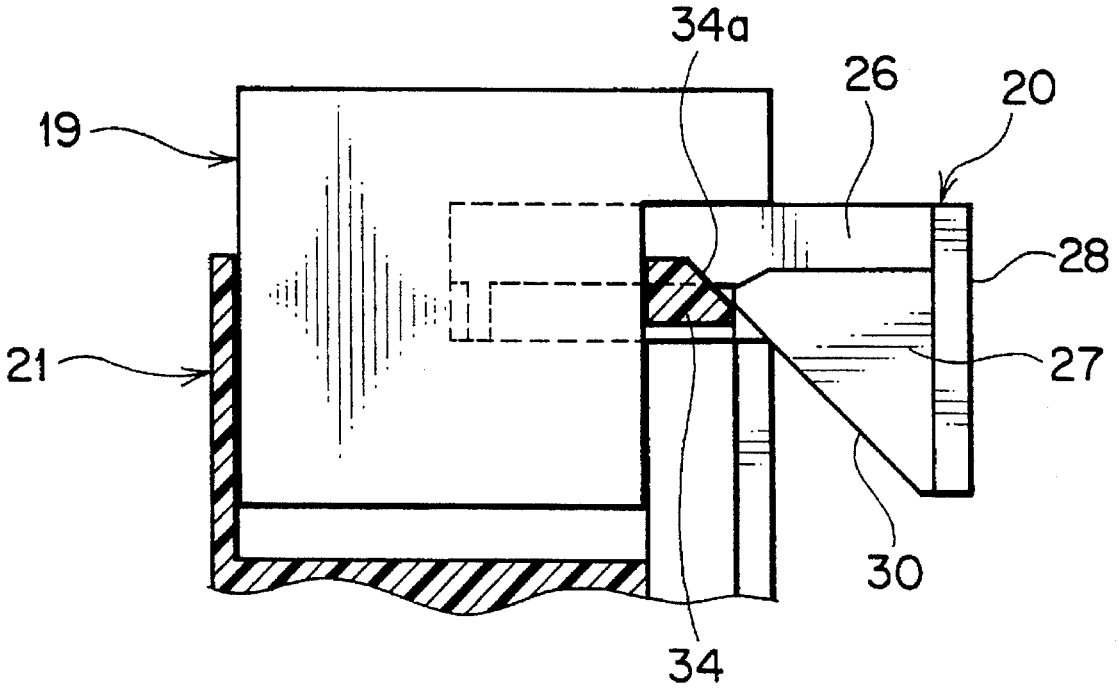
FIG. 12 is an explanatory view showing a condition in the course of engagement between the female connector housing and the male connector housing of FIG. 11.
Figure 13:
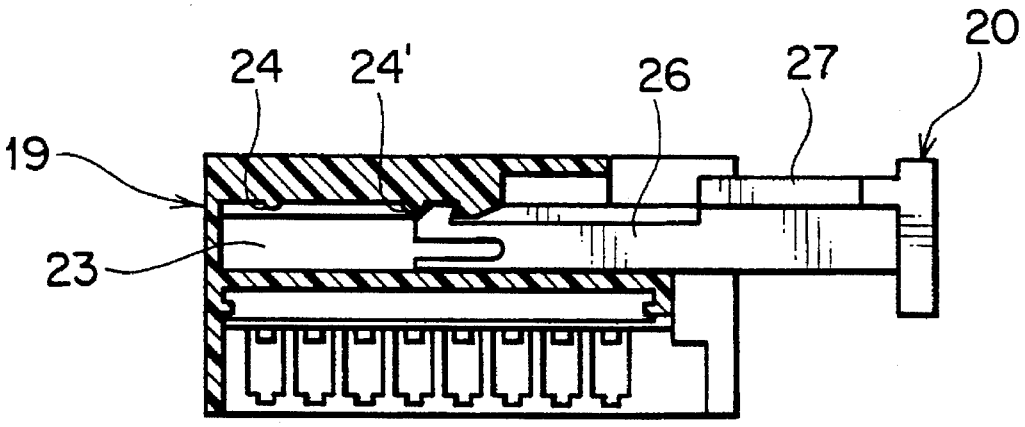
FIG. 13 is a sectional view showing a condition of the engagement detecting member of FIG. 12.

Further, as shown in FIGS. 12 and 13, with the approach of the male type connector housing 19, the sliding portion 26 is extruded from the detecting member accommodating hole 23 of the male type connector housing 19, the engaging projection 29 of the sliding portion 26 causes the urging protuberance 24' to climb over so that the engagement detecting member 20 protrudes therefrom.

Figure 14:
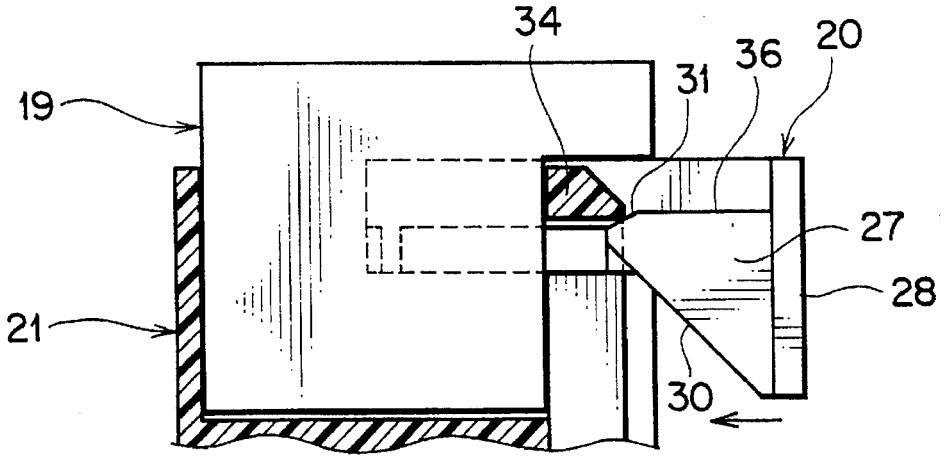
FIG. 14 is an explanatory view showing a condition in which the female connector housing and the male connector housing of FIG. 12.

As shown in FIG. 14, when the male type connector housing 19 and the female type connector housing 21 are completely engaged with each other, the inclined surface 30 of the driving portion 27 of the engagement detecting member 20 departs from the guide protuberance 34, it permits the driving portion 27 to arrive at the position where it enables the driving portion 27 to enter into the driving portion insertion hole 35.

Figure 15:
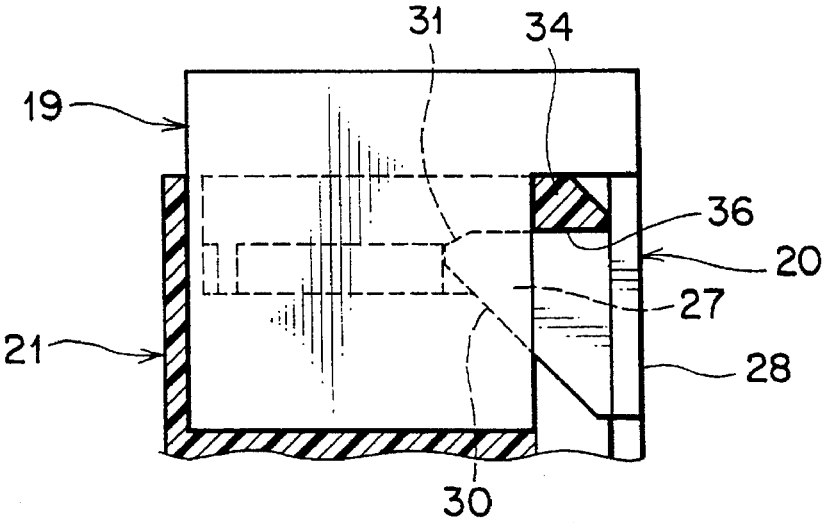
FIG. 15 is an explanatory view showing a condition in which it causes the engagement detecting member to press into the drive portion insertion hole of FIG. 14.

In this condition, as shown in FIG. 15, when it causes the operating portion 28 of the projected engagement detecting member 20 to press to the direction as indicated by the arrow, the driving portion 27 is accommodated into the driving portion insertion hole 35, with the driving portion 27 entered into the driving portion insertion hole 35. When it permits the driving portion 27 to enter into the driving portion insertion hole 35, a rear end surface 36 of the driving portion 27 comes into contact with the guide protuberance 34 so that the male type connector housing 19 and the female type connector housing 21 are locked with each other.

Even though the engagement between the male type connector housing 19 and the female type connecter housing 21 is somewhat insufficient, if the engagement guide surface 31 of the driving portion 27 rests on the position where the engagement guide surface 31 comes into contact with the guide protuberance 34, owing to pressing the operating portion 28 of the engagement detecting member 20, the engagement guide surface 31 slides to the guide protuberance 34 so that it causes the male type connector housing 19 to enter into the female type connector housing 21, with the result that it enables the perfect engagement to achieve.

On the other hand, in case of the insufficient engagement, in the condition as shown in FIG. 12, when it causes the engagement detecting member 20 to press, it enables the male type connector housing 19 to press back to the condition that the terminal of the male type connector housing 19 and the terminal of the female type connecter housing 21 are nonconducting state.

Figure 16:
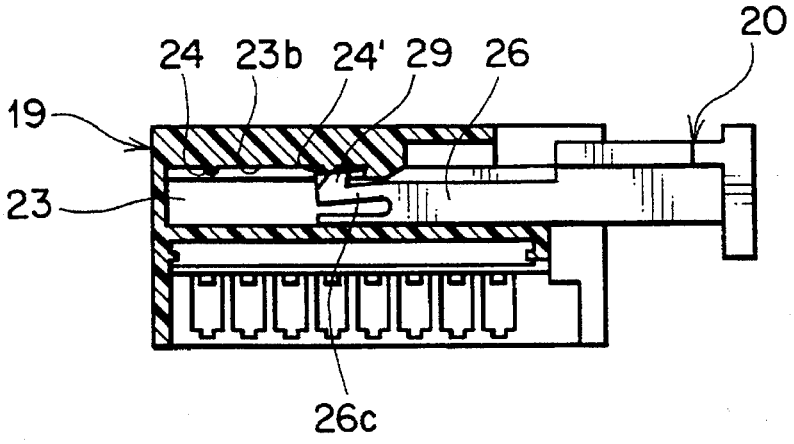
FIG. 16 is a sectional view showing a deflection of a resilient board portion of the engagement detecting member of FIG. 14.

There are provided an engaging projection 24 for engaging the engagement detecting member 20 at the inner part of the upper wall **23*b* and an urging projection 24' at the intermediate part for the upper wall 23*b* of the detecting member accommodating hole 23. Since the projection height of urging projection 24' is higher than that of the engaging projection 24, as shown in FIG. 16, with movement of the sliding portion, when the engaging projection 29 of the sliding portion 26 causes the urging protuberance 24' to climb over, necessitating relatively large pressing force. Accordingly, the engaging projection 29 which once climbs over the urging protuberance 24' simply climbs over the engaging protuberance 24** at the inner part by virtue of its inertial force so as to engage with the required position.

Namely, when it causes the resistance for climbing over the urging protuberance 24' to establish highly, in engaging, large pressing force to the engagement detecting member 20 is required, accordingly, in engaging operation, consequently it comes to the engagement detecting member 20 to operate with the precise pressing force so that the engaging operation becomes certain and reliance is improved.

In the above embodiment, the resistance for climbing over the urging protuberance 24' is highly established by raising the height of projection for the urging protuberance 24' which is higher than the engaging protuberance 24. The resistance for climbing over the urging protuberance 24' can be also highly established by changing the sectional shape thereof, while maintaining the height of the urging protuberance 24' is the same height as the engaging protuberance 24. For instance, by forming the shape of cross section for the urging protuberance 24' to be taken as rectangular shape, it is possible to raise the resistance for climbing over thereof by the engaging projection 29 of the sliding portion 26. The engaging projection 29 which climbs over the rectangular shaped urging protuberance 24' can easily climb over the engaging protuberance 24 so that it is engaged the required position.

Further, the resilient board portion **26*c* is provided for the sliding portion 26 of the engagement detecting member 20 and the taper portion 29*a* is formed at engaging projection 29. Accordingly, with the movement of the sliding portion 26, as shown in FIG. 16, since the resilient board portion 26*c* becomes susceptible to be bent downward, in the climbing over of the urging protuberance 24' and engaging protuberance 24 by the engaging projection 29 of the sliding portion 26** with the result that there is an advantage of the reduction of the insertion resistance.

Figure 17:
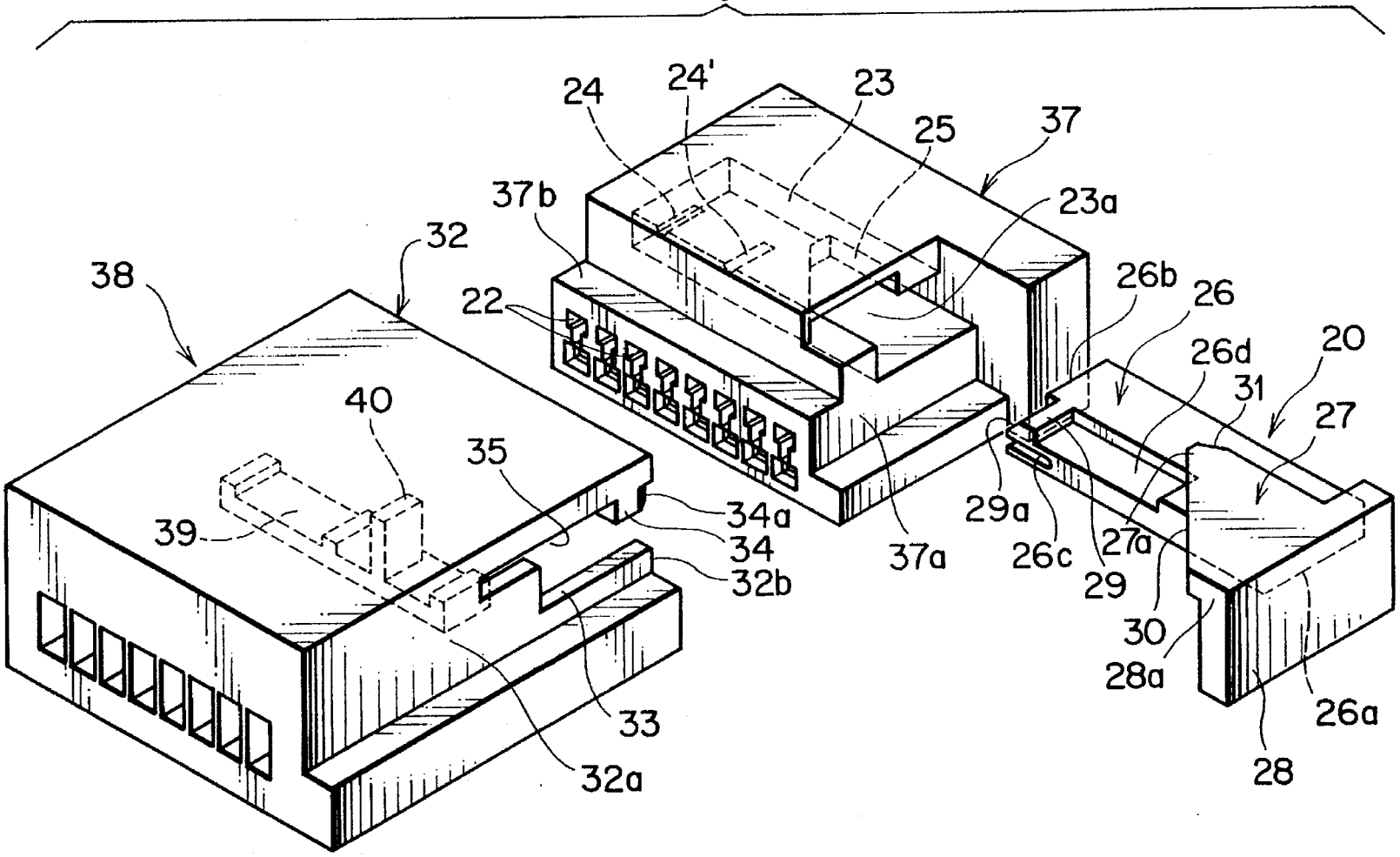
FIG. 17 is a perspective view showing a separated connector equipped with the engagement detecting member according to another embodiment of the present invention.

FIG. 17 is a perspective view showing the separated condition of the connector C with an engagement detecting member according to the another embodiment of the present invention.

The connector C with the engagement detecting member comprises a male type connector housing 37, female type connector housing 38 and the engagement detecting member 20 which is the same as that of the above embodiment.

The male type connector housing 37 is about the same shape as the male type connector housing 19 of said connector B. Namely the male type connector housing 37 is similarly formed as the male type connector housing 19 except that it permits the engagement portion **37*b* to form like the staircase above the terminal accommodating cavity 22 in front of the detection accommodating hole 23 provided for side wall 37*a*. Each areas are designated by the same symbols as that of the male type connector housing 19 accordingly, refer to FIG. 9**.

Figure 18:
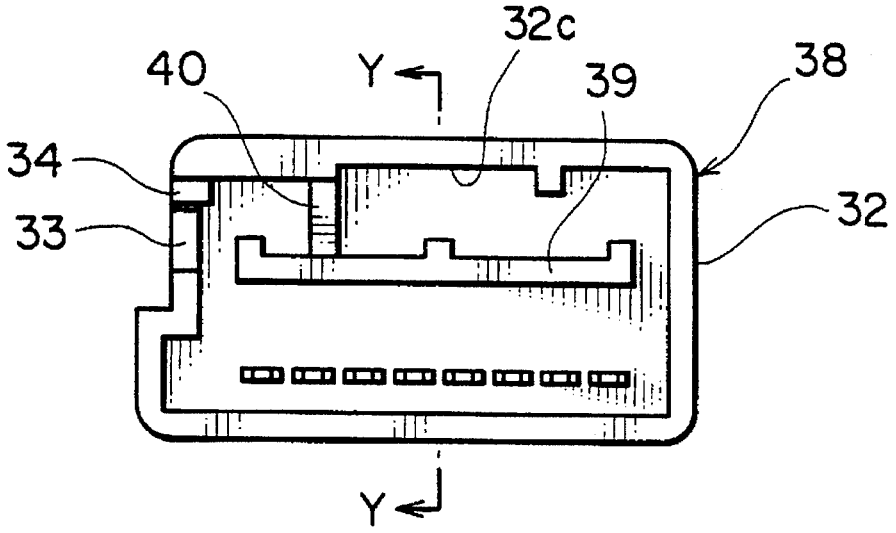
FIG. 18 is an elevational view showing the inside of a hood portion of the other connector housing of FIG. 17.
Figure 19:
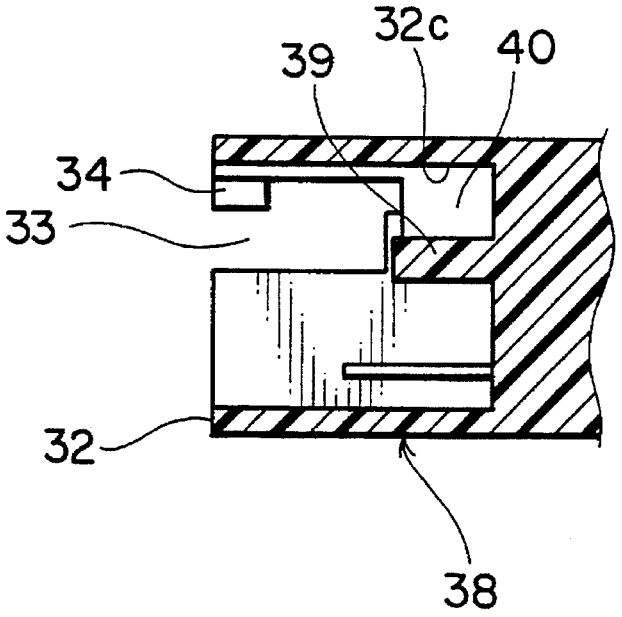
FIG. 19 is a sectional view taken along the line Y—Y of FIG. 18.
Figure 20:
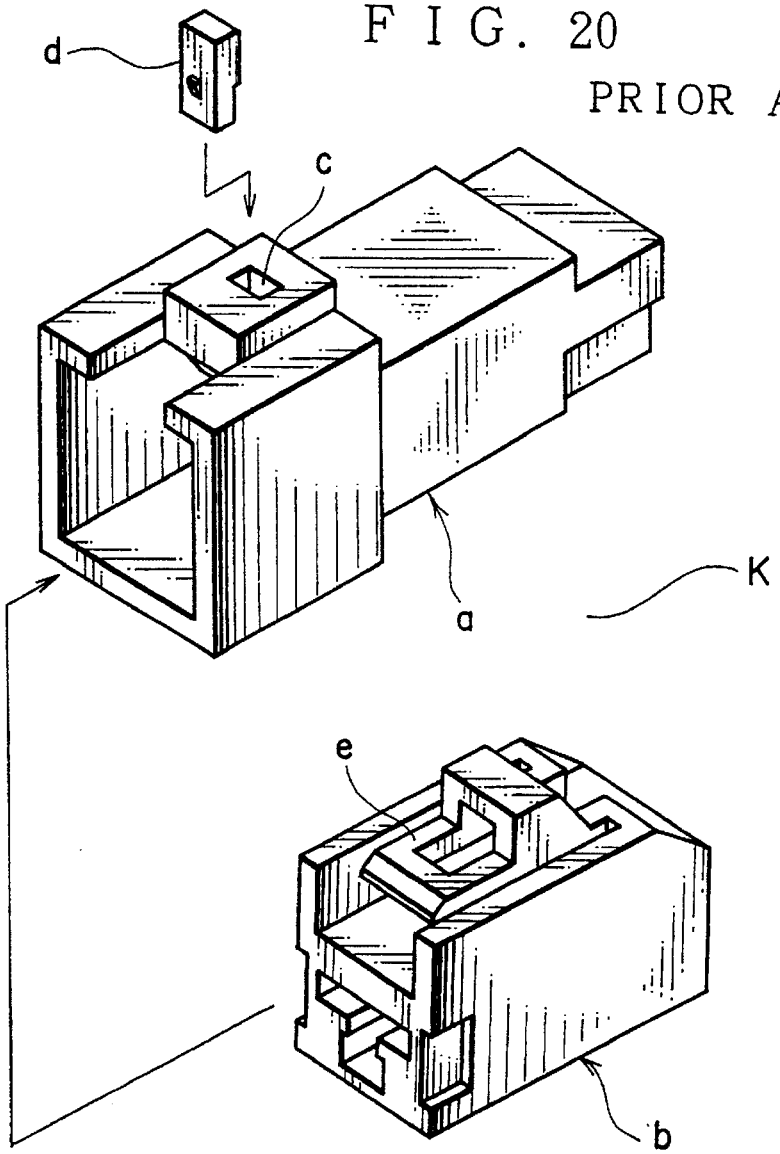
FIG. 20 PRIOR ART
FIG. 20 is a perspective view showing a conventional connector having a detecting piece.
Figure 21:
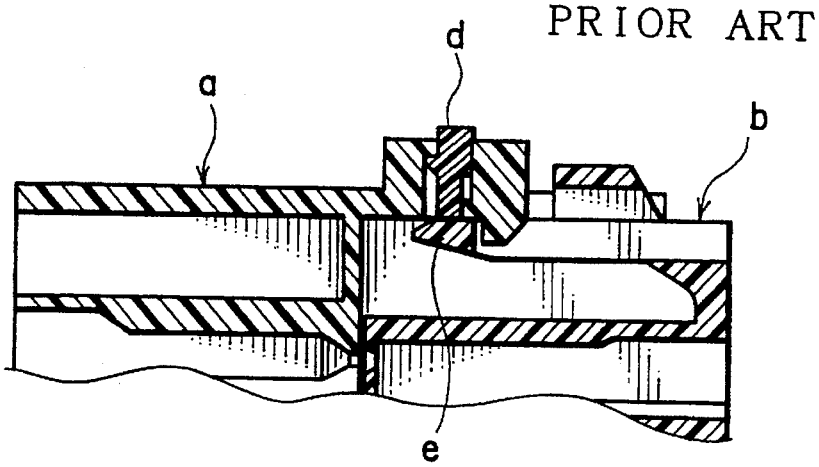
FIG. 21 PRIOR ART
FIG. 21 is an explanatory view showing a condition in which it causes the female connector housing and the male connector housing to fit with the detecting piece projected of FIG. 20.

The female type connector housing 38 has the same structure as the female type connector housing 21 of said connector B accordingly the areas thereof are designated by the same symbols as that of the female type connector housing 21. The structures which are different from those of the female type connector housing 21, as shown in FIG. 18 and 19, are in that an introducing wall 39 to the male type connector housing 19 is provided for the inside of the hood portion 32, and a reinforcing wall 40 is integrally formed between the introducing wall 39 and the ceiling wall **32*c***.

The introducing wall 39 is provided for the purpose of receiving the engagement portion **37*b* of the male type connector housing 37 accurately into the hood portion 32, in the engagement of connectors, the introducing wall 39 serves for preventing unnecessary displacement of the male type connector housing 37, and it permits the engagement operation to facilitate. The reinforcing wall 40 links about perpendicularly the ceiling wall 32*c* of the female type connector housing 38 with the introducing wall 39, it serves for preventing the obstacle that the ceiling wall 32*c* bends and gets warped caused by the opened introducing groove 33 at the side wall 32*a*. Accordingly, it is favorable to locate as close as possible to the introducing groove 33**.

The engagement operation of the connector C with the engagement detecting member is completely the same as that of the connector B with the engagement detecting member. Consequently, the descriptions of the common engagement operations are omitted here to avoid unnecessary repetition. Since the male type connector housing 38 of the connector C with the engagement detecting member provides the reinforcing wall 40 for the ceiling wall **32*c* of the hood portion 32, even though the openings such as the introducing groove 33 formed by notching the side wall 32*a* and the driving portion insertion hole 35 on the side wall 32*a* of the hood portion 32 are provided, the ceiling wall 32*c* does not bend, it enables the operation of the engagement detecting member 20** to carry out smoothly and certainly.

As described above according to the present invention, when the male type connector housing and the female type connector housing are engaged completely with each other, with the progress of the engagement, since the engagement detecting member is extruded to the outside of the connector housing, by watching the engagement detecting member projected from the side wall of the connector housing, the process of the engagement between the male type connector housing and the female type connector housing is detected easily. When the male type connector housing and the female type connector housing are completely engaged with each other, it enable the driving portion of the engagement detecting member to lock by pushing thereof into the driving portion insertion hole of the other connector housing, and it is capable of being detected easily that the engagement is perfect in accordance with the locking.

When the male type connector housing and the female type connector housing ape engaged incompletely with each other, it does not enable the driving portion to push into the driving portion insertion hole, accordingly the connectors can not be locked with each other, with the result that the incompletely engagement can easily be detected, and the undesired locking is prevented. Further, since it causes the engagement detecting member to protect laterally, it becomes possible to mount the large-sized engagement detecting member, as a result, the engagement condition is quite obvious.

Since there is provided the taper shaped engagement guide surface on the other side of the inclined surface of the driving portion, in case that the engagement between the male type connector housing and the female type connecter housing is somewhat insufficient, owing to pressing the engagement detecting member, it causes the engagement guide surface to push thereinto, while sliding to the guide protuberance so that it enables the male type connector housing to enter completely into the female type connector housing. In case of the insufficient engagement, when it causes the engagement detecting member to press, it enables the male type connector housing to press back to the condition that the terminal of the male type connector housing and the terminal of the female type connecter housing are nonconducting state.

Since there is provided the urging protuberance for the detecting member accommodating hole, in inserting the engagement detecting member into the detecting member accommodating hole, it causes the pressing force needed for climbing over the urging protuberance for the engaging projection provided for the sliding portion of the engagement detecting member to increase, by the inertial force at the time the engaging projection climbing over the urging protuberance, it becomes possible that the inertial force causes the engagement detecting member to engage surely with the required position.

Further, since there is provided the resilient board portion for the sliding portion of the engagement detecting member, there are many advantages that the engagement detecting member can move smoothly, and engaging thereof becomes certain and the like.

What is claimed is:

1. A connector equipped with an engagement detecting member, comprising:

a male connector housing;

a female connector housing engageable with said male housing;

an engagement detecting member with a driving portion, which is mounted on said male connector housing and which is freely movable in a direction perpendicular to the engagement direction of said male and female connector housings;

an inclined surface provided at said driving portion, and extending to a free end portion from a connector housing engagement side of an operating portion provided at one end of said engagement detecting member;

a guide protuberance slidably engageable with said inclined surface, disposed on an opening end of said female connector housing; and a driving portion insertion hole disposed adjacent to said guide protuberance.

2. A connector equipped with an engagement detecting member according to claim 1 further comprising, a detecting member accommodating hole being perpendicular to the engagement direction, a sliding portion of said engagement detecting member which is inserted into said detecting member accommodating hole and which is freely movable therein, and an introducing groove provided in said female connector housing, for receiving said sliding portion.

3. A connector equipped with an engagement detecting member according to claim 1 or 2, wherein said engagement detecting member is provided with a tapered engagement guide surface on the opposite side of said inclined surface of said driving portion.

4. A connector equipped with an engagement detecting member according to claim 2, further comprising, an engaging projection provided for said sliding portion of said engagement detecting member, an urging protuberance and engaging protuberance which comes into contact with said engaging projection provided for said detecting member accommodating hole, wherein said detecting member accommodating hole permits an installation of said engagement detecting member to guide by virtue of the inertial force in the insertion of said engagement detecting member.

5. A connector equipped with an engagement detecting member according to claim 2 wherein with regard to said engagement detecting member, a resilient board portion is provided for said sliding portion, and an engaging projection is provided for said resilient board portion.

6. A connector equipped with an engagement detecting member according to claim 1 or 2 further comprising, an introducing wall for said male connector housing being provided for the inside of a hood portion of said female connector housing, and a reinforcing wall provided between said introducing wall and a ceiling wall of said hood portion.

* * * * *